United States Patent [19]

Conway

[11] 4,308,815

[45] Jan. 5, 1982

[54] TANKER VESSEL CONSTRUCTION

[76] Inventor: Charles S. Conway, Featherbed La., New Vernon, N.J. 07976

[21] Appl. No.: 180,045

[22] Filed: Aug. 21, 1980

Related U.S. Application Data

[63] Continuation-in-part of Ser. No. 913,956, Jun. 9, 1978, Pat. No. 4,241,683, which is a continuation-in-part of Ser. No. 809,395, Jun. 23, 1977, abandoned.

[51] Int. Cl.[3] ..... B63B 25/08

[52] U.S. Cl. ..... 114/74 R; 114/65 R; 114/85; 114/78

[58] Field of Search ..... 114/72, 73, 74 R, 74 A, 114/74 T, 65 R, 85, 256, 78, 257, 56; 220/20, 20.5, 21, 22

[56] References Cited

U.S. PATENT DOCUMENTS

| | | | |
|---|---|---|---|
| 3,357,391 | 12/1967 | Field | 114/74 R |
| 3,499,410 | 3/1970 | Field | 114/74 R |
| 3,554,152 | 1/1971 | Campbell | 114/74 R |
| 3,640,237 | 2/1972 | Phelps | 114/74 A |
| 3,653,531 | 4/1972 | Zurmuehlen | 220/22 |
| 3,745,960 | 7/1973 | Devine | 114/74 R |

FOREIGN PATENT DOCUMENTS

| | | | |
|---|---|---|---|
| 2118019 | 11/1971 | Fed. Rep. of Germany | 114/74 R |
| 1302476 | 1/1973 | United Kingdom | 114/74 R |

OTHER PUBLICATIONS

Intl. Maritime Dict. (6th Ed. 1958) p. 748.

*Primary Examiner*—Trygve M. Blix
*Assistant Examiner*—D. W. Keen
*Attorney, Agent, or Firm*—Kenyon & Kenyon

[57] ABSTRACT

A tanker vessel for carrying liquid cargoes having a specific gravity which is less than that of sea water. The vessel includes a hull, comprising a bottom and sides, a top deck and at least one cargo compartment. The top deck is located at a distance above the hull bottom which is approximately equal to $H(S_w/S_c)$, where H represents the distance from the bottom of the vessel to its waterline, $S_w$ represents the specific gravity of sea water, and $S_c$ represents the specific gravity of the liquid cargo. The compartment is filled with cargo to a point below the top deck of the vessel which is located at a distance above the vessel's bottom which is approximately equal to $H(S_w/S_c-0.03H$.

In another embodiment, the top deck is located at a distance above the hull bottom which is approximately equal to $H(S_w/S_{cL})$, where $S_{cL}$ represents the specific gravity of the lightest cargo the vessel is adapted to carry, and swash bulkheads extend downwardly from the top deck into the cargo compartments to a point located at a distance above the vessel's bottom which is approximately equal to $H(S_w/S_{cH})-0.35H$, for damping surface movement of the cargo during movement of the vessel. The compartments are filled with cargo to a point below the top deck located at a distance above the vessel's bottom which is approximately equal to $H(S_w/S_c)$, where $S_c$ represents the specific gravity of the cargo stored in the compartments.

8 Claims, 6 Drawing Figures

TANKER VESSEL CONSTRUCTION

This application is a continuation-in-part of my earlier copending application, Ser. No. 913,956 filed June 9, 1978, now U.S. Pat. No. 4,241,683, which in turn is a continuation-in-part of application Ser. No. 809,395 filed June 23, 1977, now abandoned.

BACKGROUND OF THE INVENTION

1. Field of the Invention

The present invention relates generally to tanks in a fluid, and in particular to an improved construction for a tanker vessel for transporting liquid cargoes.

2. Description of the Prior Art

Tanker vessels for the transportation in bulk of liquid cargo are known in the art. See, for example, U.S. Pat. No. 2,918,032. Such tanker vessels generally comprise a plurality of liquid-tight transverse bulkheads and one or more liquid-tight longitudinal bulkheads which subdivide the tanker vessel into a plurality of liquid-tight storage compartments. If the bottom or a side of the hull of such a tanker vessel is ruptured by grounding or some other accident, the affected cargo tanks will leak until the "pressure head" of the liquid cargo in each tank, i.e., approximately the portion of the liquid cargo disposed above the waterline of the vessel, flows out of the tanker vessel. Such leakage is a significant potential problem in so-called "SWBT" and "double-bottom" tanker vessels which have greater freeboard than conventional tanker vessels, and, hence, a greater cargo pressure head.

In recent years, pollution by oil tankers as a result of a hull rupture caused by grounding or other major catastrophe has become of increasing concern. As a result, various anti-pollution tanker constructions have been proposed. One of these is the so-called "double-bottom" tanker design which essentially comprises a tanker vessel having two spaced-apart hull bottoms. The purpose of this design is to prevent leakage from the tanker's cargo tanks if the outer hull bottom is ruptured by, for example, grounding. Such a design may not prevent leakage, however, where major damage is caused by grounding or some other accident since such damage may also cause the inner hull bottom to rupture in addition to the outer one. Moreover, besides the additional expenses involved in manufacturing such a tanker, the space between the inner and outer hull bottoms is unusable for the transportation and storage of cargo and, as a result, such a design increases the expenses of operating and maintaining the tanker. Bottom damage repair costs are also significantly greater in such tanker vessels, and such double-bottom tanker vessels require a rigid internal structure to support the huge loading stress of the cargo on the inner hull bottom and water on the outer hull bottom which tends to rupture both the inner and outer hull bottoms when hull damage occurs.

It has also been proposed to construct a tanker vessel with double sides defining side tanks extending from the top deck of the vessel to the hull bottom which are disposed adjacent to and associated with cargo tanks in the vessel. See U.S. Pat. No. 3,832,966. These side tanks have a volume from the hull bottom to the waterline of the tanker vessel which is equal to the respective volumes of the cargo tanks above the waterline. Valves coupling the side tanks to the cargo tanks are opened if the tanker hull is ruptured to permit oil in the cargo tanks to drain off into the side tanks so that the oil above the waterline in the cargo tanks does not escape from the ruptured hull bottom. Larger vents are used in the side tanks than in the cargo tanks to achieve this drainage from the cargo tank to the side tanks instead of into the sea. The disadvantage of this design, however, is that the side tanks provided for receiving the "pressure head" of the liquid cargo carried in the cargo tank is, similar to the space between the inner and outer hull bottoms in a double-bottom tanker, unavailable for the storage and transportation of cargo and, accordingly, increases the fabrication, maintenance and operating costs of the tanker vessel. Moreover, such a design is theoretical only and in practice would save no more than 2 or 3% of the liquid cargo carried by such a tanker vessel.

Generally speaking, ocean-going tanker vessels are required by international regulations to have a minimum amount of extra buoyancy to provide for floatation in the event of a hull rupture due to grounding, collision, or the like. This extra buoyancy is controlled by an assigned vessel free-board which is determined by measurements and calculations for each vessel. Existing ocean-going vessels generally have free-board assignments which, depending upon their size, place the main deck of the vessel at a location which is approximately 11 to 23 feet or more above the waterline of the vessel when fully loaded. Thus, since petroleum products, with rare exceptions, are lighter than water, in the event of a rupture below the waterline the products are supportable by water only to a predetermined level above which any cargo located in the cargo compartment will displace an equivalent amount of cargo through the rupture in the hull.

SUMMARY OF THE INVENTION

It is, therefore, an object of the present invention to provide an improved tanker vessel construction which overcomes the aforementioned disadvantages of heretofore known constructions and reduces fluid cargo losses and pollution in the case of rupture of the tanker hull.

It is also an object of the present invention to provide an improved tanker vessel construction which reduces cargo losses at sea and in port from ruptures caused by bottom or side hull damage, corrosion, fracture leakage, and tanker operational or personnel error.

It is another object of the present invention to provide an improved tanker vessel construction which reduces stability problems occurring as a consequence of major hull bottom damage to the tanker vessel's cargo tanks.

It is still a further object of the present invention to provide an improved tanker vessel construction which serves as an inherently safe tanker vessel anti-pollution system and is simultaneously fully usable for the transportation and storage of liquid cargo.

These and other objects of the present invention are achieved in a tanker vessel for carrying liquid cargo having a specific gravity which is less than that of sea water. The vessel includes a hull comprising a bottom and sides, a top deck and at least one cargo compartment disposed between the top deck and the hull bottom for storing the liquid cargo. The improvement comprises the top deck of the vessel being located at a distance above the hull bottom which is approximately equal to $H(S_w/S_c)$, where H represents the distance from the bottom of the vessel to its waterline, $S_w$ represents the specific gravity of sea water, and $S_c$ represents the specific gravity of the liquid cargo, and the cargo compartment being filled with the liquid cargo to a point below the top deck of the vessel located at a distance above the vessel's bottom which is approximately equal to $H(S_w/S_c)-0.03H$.

The foregoing objects of the invention are also achieved in a tanker vessel adapted for carrying a plurality of liquid cargoes having different specific gravities, each of which is less than that of sea water and being greater than or equal to $S_{cL}$ and less than or equal to $S_{cH}$, where $S_{cL}$ represents the specific gravity of the lightest liquid cargo which the vessel is adapted to carry and $S_{cH}$ represents the specific gravity of the heaviest liquid cargo which the vessel is adapted to carry. The vessel includes a hull comprising a bottom and sides, a top deck, and at least one cargo compartment disposed between the top deck and the hull bottom for storing the liquid cargo. The improvement comprises the top deck of the vessel being located at a distance above the bottom of the vessel which is approximately equal to $H(S_w/S_{cL})$, where H represents the distance from the bottom of the vessel to its waterline and $S_w$ represents the specific gravity of sea water. Swash bulkhead means are disposed in the cargo compartment and extend downwardly from the top deck of the vessel into the compartment to a point below the surface of the liquid cargo stored in the compartment located at a distance above the bottom of the vessel which is approximately equal to $H(S_w/S_{cH})-0.15H$, the cargo compartment being filled with the liquid cargo to a point below the top deck of the vessel located at a distance above the bottom which is approximately equal to $H(S_w/S_c)$, where $S_c$ represents the specific gravity of the liquid cargo stored in the cargo compartment, the swash bulkhead means damping surface movement of the liquid cargo is the cargo compartment during movement of the tanker vessel.

In a preferred embodiment of the invention, the cargo compartment of the vessel is filled with the liquid cargo to a point below the top deck of the vessel located at a distance above the bottom of the vessel which is approximately equal to $H(S_w/S_c)-0.03H$. The cargo compartment of the vessel may also be partially filled with the liquid cargo to a point below the top deck of the vessel located at a distance above the vessel's bottom which is less than $H(S_w/S_c)-0.03H$, and the swash bulkhead means extend downwardly into the cargo compartment to a point below the top deck of the vessel located at a distance above the vessel bottom which is approximately equal to $H(S_w/S_{cH})-0.35H$.

The present invention eliminates the pressure head of the liquid cargo in the cargo compartment of the vessel, thus greatly reducing the potential outflow, i.e., leakage of cargo carried by the vessel. Thus, in contrast to conventional tankers, including double-bottom tankers (when the inner hull bottom of such a tanker is ruptured), which will leak rapidly upon rupture of the bottom or sides of the hull until the pressure head of the cargo has been lost or is removed, a vessel constructed according to the invention will leak a lesser amount of liquid cargo, if any, upon the occurrence of a bottom hull rupture due to the lighter specific gravity of the liquid cargo carried by the vessel compared to water, and should virtually eliminate major hull bottom leakage. Leakage through ruptures in the sides of the hull of the vessel may also be considerably reduced. Thus, massive marine pollution incidents caused by grounding and major accidents should be reduced to minor pollution incidents.

Aside from the foregoing, there are numerous other advantages provided by a tanker vessel constructed in accordance with the invention. For example, bottom damage repair costs following grounding are greatly reduced compared to vessels with double bottoms. Also, the safety of the vessel is considerably enhanced compared to other types of ships following major accident or grounding damage in cargo tank areas since the vessel will practically maintain its normal trim and draft when all of the cargo tanks are loaded, no matter which cargo tanks are ruptured. As a result, a tank vessel constructed according to the invention which sustains major damage on its cargo tank section only, is virtually unsinkable, regardless the extent of the damage to the hull bottom, as long as the longitudinal structural integrity of the vessel still exists. A tank vessel constructed according to the invention will also have little or no change in buoyancy after grounding damage to its cargo tanks unlike double-bottom and conventional tanker vessels which, upon grounding, may lose buoyancy rapidly.

Thus, the trim and stability of a vessel constructed in accordance with the present invention will be affected less and pollution, if any, will be considerably less than in a conventional tanker following a casualty thereby enhancing the vessel's safety and environmental desirability.

These and other novel features and advantages of the invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figures 1, 4, 5, 6:
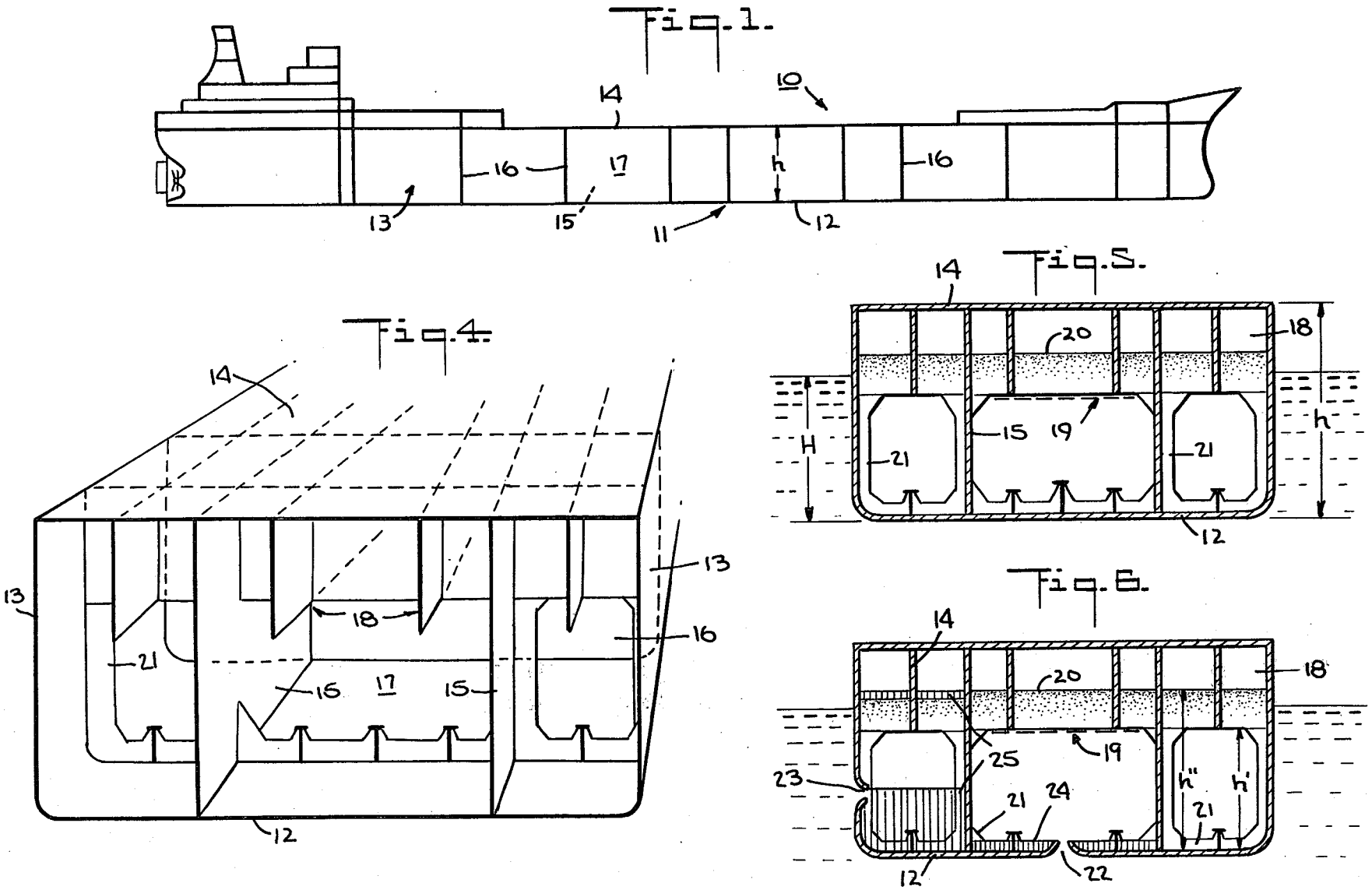
FIG. 1 is a longitudinal side view of one embodiment of an improved tanker vessel constructed according to the present invention.
FIG. 4 is a perspective view of the cargo tanks of the tanker vessel.
FIG. 5 is a transverse cross-sectional view of the tanker vessel taken along Section 5—5 of FIG. 3.
FIG. 6 is another transverse cross-sectional view of the tanker vessel illustrating side and bottom hull ruptures caused by grounding and side damage thereof.
Figure 2:
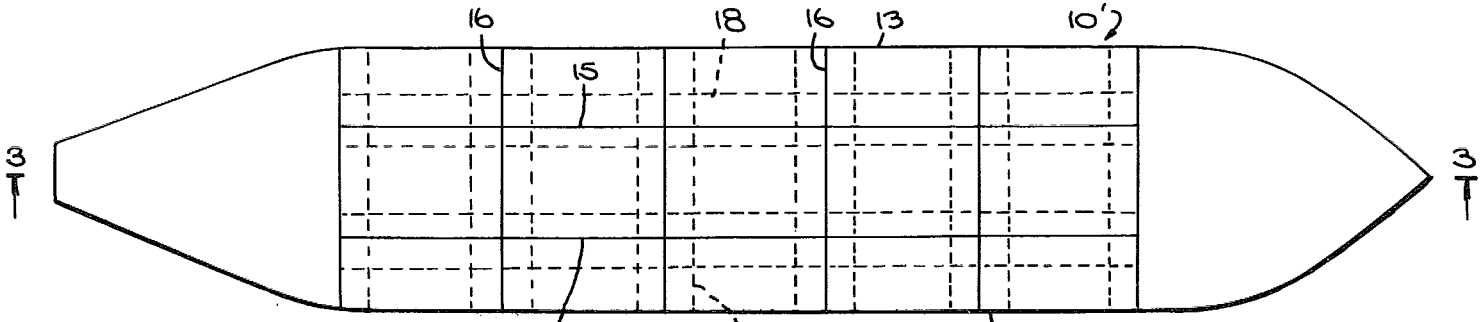
FIG. 2 is a top plan view of another tanker vessel constructed according to the present invention.
Figure 3:
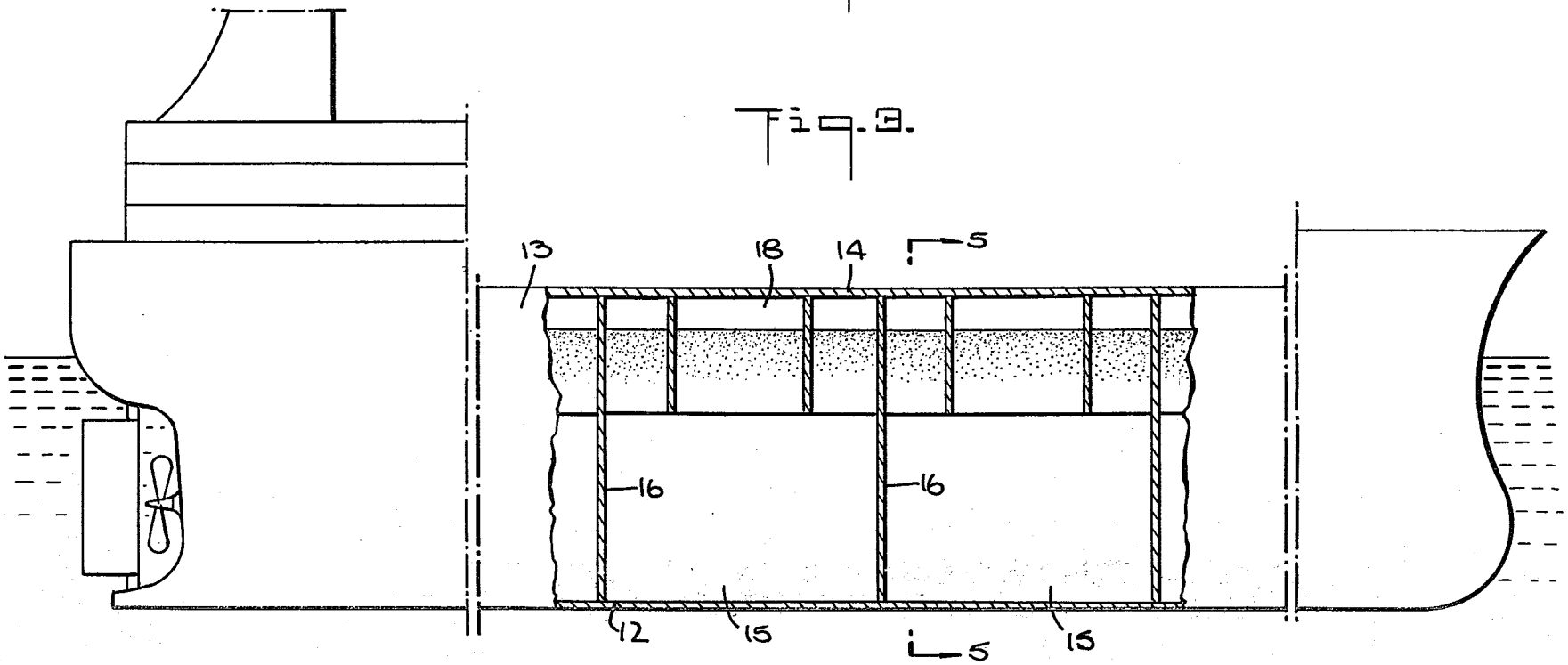
FIG. 3 is a partial, longitudinal cross-sectional view of the vessel taken along Section 3—3 of FIG. 2.

Referring now to the drawings, and in particular to FIG. 1, there is shown a tanker vessel 10 which includes a hull 11 comprising a bottom 12 and sides 13. The vessel also includes a top or main deck 14 and a plurality of longitudinal and transverse bulkheads 15 and 16, respectively, which are disposed within the hull of the vessel and form a plurality of watertight cargo compartments 17 between top deck 14 and hull bottom 12 of the vessel for storing and carrying liquid cargo which has a specific gravity less than that of sea water and is immiscible with sea water. Top deck 14 of the vessel is located above the waterline of the vessel and also at a vertical distance h above the hull bottom 12 of the vessel which is approximately equal to the neutral pressure height in the cargo compartments, i.e., the maximum vertical height at which the cargo carried by the vessel will be supported by the water in which the vessel is disposed which is given by the equation $H(S_w/S_c)$, where H represents the vertical height of the waterline of the vessel above hull bottom 12, i.e., the vessel draught, $S_w$ represents the specific gravity of sea water, and $S_c$ represents the specific gravity of the cargo carried by the vessel. With respect to the waterline of the vessel, top deck 14 is located at a vertical distance above the waterline which is less than or equal to $H(S_w/S_c-1)$. The compartments are filled or loaded with liquid cargo to a point below top deck 14 of the vessel located at a distance above the bottom 12 of the vessel which is approximately equal to $H(S_w/S_c)-0.03H$. The vessel may also be adapted to carry a plurality of liquid cargoes having different specific gravities, each of which is less than that of sea water. In this embodiment, $S_c$ represents the specific gravity of the heaviest liquid cargo the vessel is adapted to carry. Since this design will produce a less than required freeboard, dedicated buoyancy will be necessary. These dedicated spaces should be mostly located at, or near the vessel's ends, and should be well compartmented. They may serve as ballast tanks.

It should be noted that the term "waterline" as used herein refers to the load line of the vessel which is required to be used during its operation, for example, the vessel's summer draught, and that as known to those persons skilled in the art, the location of the waterline may vary slightly with respect to its height above the vessel's hull bottom according to the load line utilized.

It is unacceptable to partially load cargo tanks of a tanker vessel, i.e., to a level less than the level specified previously herein, except for a few partially loaded, or trimming tanks. The cargo compartments of a tanker vessel loaded to this level are approximately 98% full, which is typical. In order to be able to load most or all of a vessel's tanks to a partial capacity, the tank design must be modified so as to reduce surface movement of the liquid cargo carried in the tanks caused by movement of the tanker vessel.

The foregoing is achieved by the tanker vessel construction illustrated in FIGS. 2–6, which is adapted for carrying a plurality of liquid cargoes having different specific gravities, each of which is less than that of sea water. These specific gravities are greater than or equal to $S_{cL}$ and less than or equal to $S_{cH}$, where $S_{cL}$ represents the specific gravity of the lightest cargo the vessel is adapted to carry and $S_{cH}$ represents the specific gravity of the heaviest cargo the vessel is adapted to carry. In the embodiment of the invention illustrated in FIGS. 2–6, the top deck 14 of the vessel is located at a distance h above bottom 12 which is approximately equal to $H(S_w/S_{cL})$, where H represents the distance from the bottom 12 of the vessel to its waterline and $S_w$ represents the specific gravity of sea water. Swash bulkhead means comprising a plurality of planar swash bulkheads 18 are disposed in the cargo compartments 17 and extend transversely with respect to bottom 12 of vessel 10'. For larger vessels, such as that illustrated, the bulkheads also extend longitudinally with respect to bottom 12 in compartments 17. The swash bulkheads extend downwardly from top deck 14 of vessel 10' into each of the compartments 17 to a point, indicated by dashed line 19 in FIGS. 5 and 6, below the surface of the cargo stored in each compartment located at a distance h' above hull bottom 12 which is approximately equal to $H(S_w/S_{cH})-0.15H$. Cargo compartments 17 are each filled with liquid cargo to a point below top deck 14 of vessel 10', indicated by line 20 in FIGS. 5 and 6, located at a distance h'' above bottom 12, which is approximately equal to $H(S_w/S_c)$, and preferably $H(S_w/S_c)-0.03H$, where $S_c$ represents the specific gravity of the liquid cargo stored in the cargo compartment. If the cargo compartments 17 are partially filled with liquid cargo to a point below top deck 14 of the vessel located at a distance above bottom 12 which is less than $H(S_w/S_c)-0.03H$, swash bulkheads 18 preferably extend downwardly into cargo compartments 17 to a point below top deck 14 of the vessel located at a distance above bottom 12 which is approximately equal to $H(S_w/S_{cH})-0.35H$. The swash bulkheads permit the carriage of liquid cargo in partially loaded tanks by reducing liquid cargo sloshing, and thereby maintaining within acceptable limits the dynamic loading forces imposed upon longitudinal and transverse bulkheads 15 and 16 of the vessel. The swash bulkheads may be mounted on or integrally formed with the vessel's transverse web frames 21 and the vessel's longitudinal web frames (not shown). It should be noted that the swash bulkheads may also be perforated and corrugated in shape in addition to the non-perforated, planar form shown in the drawings. The length and width of the tanks will dictate the number of longitudinal and transverse upper tank swash bulkheads required.

FIG. 6 illustrates the operation of the invention upon the occurrence of damage to hull bottom 12 caused by hull bottom rupture 22 and side hull rupture 23 resulting from docking, barge, tug or similar damage. In the case of rupture 22, a negligible amount of cargo, illustrated by shaded area 24, is lost, if any, since the fluid pressure head of the liquid cargo in cargo compartments 17 has been basically eliminated in the affected cargo compartments. Since the liquid cargo in the cargo compartments has a specific gravity which is less than that of sea water, outflow of the pressure head of the liquid cargo in the affected cargo compartment is prevented, or greatly reduced. In the case of side hull rupture 23, a larger amount of cargo, illustrated by reference numeral 25, is lost, namely, that portion of the cargo which extends up to the height of rupture 23 in the hull, plus that portion of the cargo disposed above the pressure head which exists above the point of rupture. Leakage of the liquid cargo from the cargo compartment by sea water displacement may be relatively slow. This may permit some of the liquid cargo to be transferred from the affected cargo tank to another cargo tank of the vessel by means of a liquid cargo charging and discharging means, such as that illustrated in my aforementioned copending application Ser. No. 913,956.

In summary, the improved tanker vessel construction described herein will result in an anti-pollution tank vessel with the capability of transporting cargo of varying specific gravities in basic equilibrium with sea water, thereby minimizing or virtually eliminating cargo outflow following accidents resulting in hull ruptures. In conjunction with the above, when loading such a vessel, cargoes are to be loaded by ullage control in accordance with predetermined ullage data which should be included in the vessel's cargo loading manual, thereby providing data indicating the minimum loading ullages for all tanks of the vessel for all specific gravities of liquid cargo within the vessel's design parameters.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a tanker vessel for carrying liquid cargo having a specific gravity which is less than that of sea water, said vessel including a hull comprising a bottom and sides, a top deck, and at least one cargo compartment disposed between said top deck and said hull bottom for storing said liquid cargo, the improvement comprising said top deck of said vessel being located at a distance above said hull bottom which is approximately equal to $H(S_w/S_c)$, where H represents the distance from the bottom of said vessel to its waterline, $S_w$ represents the specific gravity of sea water, and $S_c$ represents the specific gravity of said liquid cargo, said cargo compartment being filled with said liquid cargo to a point below said top deck of said vessel located at a distance above said bottom of said vessel which is approximately equal to $H(S_w/S_c)-0.03H$.

2. The improvement recited in claim 1, wherein said vessel is adapted for carrying a plurality of liquid cargoes having different specific gravities each of which is less than that of sea water, and wherein $S_c$ represents the specific gravity of the heaviest liquid cargo which said vessel is adapted to carry.

3. In a tanker vessel adapted for carrying a plurality of liquid cargoes having different specific gravities each of which is less than that of sea water, said specific gravities being greater than or equal to $S_{cL}$ and less than or equal to $S_{cH}$, where $S_{cL}$ represents the specific gravity of the lightest liquid cargo which said vessel is adapted to carry and $S_{cH}$ represents the specific gravity of the heaviest liquid cargo which said vessel is adapted to carry, said vessel including a hull comprising a bottom and sides, a top deck, and at least one cargo compartment disposed between said top deck and said hull bottom for storing said liquid cargo, the improvement comprising said top deck of said vessel being located at a distance above said bottom of said vessel which is approximately equal to $H(S_w/S_{cL})$, where H represents the distance from said bottom of said vessel to its waterline and $S_w$ represents the specific gravity of sea water, and said vessel further comprising swash bulkhead means disposed in said cargo compartment and extending downwardly from said top deck of said vessel into said compartment to a point below the surface of the liquid cargo stored in said compartment which is located at a distance above said bottom of said vessel which is approximately equal to $H(S_w/S_{cH})-0.15H$, said cargo compartment being filled with said liquid cargo to a point below said top deck of said vessel which is located at a distance above said bottom which is approximately equal to $H(S_w/S_c)$, where $S_c$ represents the specific gravity of the liquid cargo stored in said cargo compartment, said swash bulkhead means damping surface movement of said liquid cargo in said cargo compartment during movement of said tanker vessel.

4. The improvement recited in claim 3, wherein said cargo compartment of said vessel is filled with said liquid cargo to a point below said top deck of said vessel located at a distance above said bottom which is approximately equal to $H(S_w/S_c)-0.03H$.

5. The improvement recited in claim 4, wherein said cargo compartment of said vessel is partially filled with said liquid cargo to a point below said top deck of said vessel located at a distance above said bottom of said vessel which is less than $H(S_w/S_c)-0.03H$, and wherein said swash bulkhead means extends downwardly into said cargo compartment to a point below said top deck of said vessel located at a distance above said bottom which is approximately equal to $H(S_w/S_{cH})-0.35H$.

6. The improvement recited in claim 5, wherein said swash bulkhead means are disposed in said cargo compartment transversely with respect to said bottom of said vessel.

7. The improvement recited in claim 6, wherein said swash bulkhead means are disposed in said cargo compartment longitudinally and transversely with respect to said bottom of said vessel.

8. The improvement recited in claim 7, wherein said vessel includes a plurality of longitudinally and transversely disposed vertical bulkheads disposed in said vessel between said hull bottom and said top deck, said bulkheads forming a plurality of watertight cargo compartments for storing said liquid cargo, said swash bulkhead means being disposed in each of said cargo compartments longitudinally and transversely with respect to said bottom of said vessel.

* * * * *

UNITED STATES PATENT AND TRADEMARK OFFICE

CERTIFICATE OF CORRECTION

PATENT NO. : 4,308,815

DATED : January 5, 1982

INVENTOR(S) : Charles S. Conway

It is certified that error appears in the above—identified patent and that said Letters Patent is hereby corrected as shown below:

In the Abstract, last line of paragraph 1, change "$H(S_W/S_C-0.03H$" to -- $H(S_W/S_C) - .03H$ --.

Column 2, line 5, after "cargo", change "tank" to -- tanks --.

Column 3, line 36, after "cargo", change "is" to -- in --.

Column 4, line 15, after "damage", change "on" to -- in --.

Signed and Sealed this

*Thirteenth* Day of *April 1982*

[SEAL]

*Attest:*

GERALD J. MOSSINGHOFF

*Attesting Officer*

*Commissioner of Patents and Trademarks*